US010932572B1

(12) United States Patent
Leggette

(10) Patent No.: US 10,932,572 B1
(45) Date of Patent: Mar. 2, 2021

(54) HEIGHT-ADJUSTING STOOL

(71) Applicant: Veronica Leggette, Fayetteville, NC (US)

(72) Inventor: Veronica Leggette, Fayetteville, NC (US)

( * ) Notice: Subject to any disclaimer, the term of this patent is extended or adjusted under 35 U.S.C. 154(b) by 75 days.

(21) Appl. No.: 16/423,286

(22) Filed: May 28, 2019

(51) Int. Cl.
*A47C 3/20* (2006.01)
*A47C 3/24* (2006.01)
*A47C 16/02* (2006.01)
*A47C 7/00* (2006.01)

(52) U.S. Cl.
CPC ..... *A47C 3/20* (2013.01); *A47C 7/006* (2013.01); *A47C 16/02* (2013.01); *A47C 16/025* (2013.01)

(58) Field of Classification Search
CPC ..... A47C 3/20; A47C 7/006; A47C 16/02; A47C 16/025
USPC .... 297/423.41, 423.44, 423.45, 344.17, 461; 280/32.5
See application file for complete search history.

(56) References Cited

U.S. PATENT DOCUMENTS 2,233,262 A * 2/1941 Jacobson ..... A61G 3/061 297/344.15 X
2,579,577 A * 12/1951 Fayra ..... A47C 16/025 297/423.45 X
2,780,277 A 2/1957 Ries
2,821,242 A * 1/1958 Manegold ..... A61G 7/1003 297/344.15 X
3,237,921 A * 3/1966 Jay ..... B66F 7/065 254/122
4,232,901 A * 11/1980 Harrington ..... A47C 16/025 297/423.45
4,469,372 A 9/1984 Long
5,072,955 A * 12/1991 Holland ..... B25H 1/16 280/32.5
5,251,864 A * 10/1993 Itou ..... B60N 2/502 297/344.12 X
5,285,992 A * 2/1994 Brown ..... B66F 7/0608 297/423.45 X
5,611,551 A * 3/1997 Lin ..... B25H 5/00 280/32.5
D381,170 S 7/1997 Dawkins
5,695,248 A * 12/1997 Bell ..... A47C 3/30 297/344.17 X
5,707,067 A 1/1998 Smith
5,800,016 A * 9/1998 Allred ..... A61G 5/1059 297/344.17 X
6,010,187 A * 1/2000 Dallas ..... A47C 7/626 280/32.5 X
6,199,877 B1 3/2001 Shockley
(Continued)

FOREIGN PATENT DOCUMENTS

WO 2011130160 10/2011

*Primary Examiner* — Rodney B White
(74) *Attorney, Agent, or Firm* — Kyle A. Fletcher, Esq.

(57) ABSTRACT

The height-adjusting stool is a seat, which may change height between a minimum height and a maximum height by activating a motor to move a scissor jack located beneath the seat. The motor may be battery-operated. A plurality of wheels may allow the height-adjusting stool to be repositioned by rolling to one side or the other. One or more wheel locks may prevent the plurality of wheels from rolling when stationary positioning is desired. A three-position switch may allow the user to move the seat up or down or to cease motion of the seat.

17 Claims, 4 Drawing Sheets

(56) References Cited

U.S. PATENT DOCUMENTS

| | | | | |
|---|---|---|---|---|
| 6,474,742 | B1 * | 11/2002 | Robinson | A47C 16/02 297/423.45 X |
| 7,314,248 | B2 * | 1/2008 | Mabon | A47B 9/08 297/344.15 X |
| 7,341,310 | B1 * | 3/2008 | Ross | A47C 3/36 297/344.17 X |
| 7,926,876 | B2 * | 4/2011 | Zadai | B66F 3/12 297/344.17 |
| 7,966,947 | B2 * | 6/2011 | Roleder | A47C 19/22 297/423.41 X |
| 8,544,947 | B2 * | 10/2013 | Sloan | B62J 1/08 297/215.13 |
| 8,596,651 | B2 * | 12/2013 | Canova | A47C 3/36 280/32.5 |
| 9,370,458 | B2 * | 6/2016 | Wem | A61G 7/1046 |
| 9,585,489 | B1 * | 3/2017 | Al-Quraini | A47C 16/025 |
| 9,713,560 | B1 * | 7/2017 | Raymond | A61G 5/1059 |
| 10,400,510 | B2 * | 9/2019 | Niemiec | A47B 88/413 |
| 2004/0104560 | A1 | 6/2004 | Tedesco | |
| 2006/0102816 | A1 | 5/2006 | Zhang | |
| 2015/0366729 | A1 * | 12/2015 | Quick | A61G 5/1059 297/88 |
| 2016/0089286 | A1 * | 3/2016 | Infantino | A61G 15/12 297/423.45 X |
| 2017/0099954 | A1 | 4/2017 | Chao | |
| 2018/0014653 | A1 | 1/2018 | Reynolds | |

* cited by examiner

HEIGHT-ADJUSTING STOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of stools, more specifically, a height-adjusting stool.

Some tasks may require that an individual kneel to reach very low items. Non-limiting examples of such tasks include stocking shelves, cleaning, and gardening. For individuals with mobility issues, joint problems, or back injuries kneeling and rising from a kneeling position may be difficult or painful.

SUMMARY OF INVENTION

The height-adjusting stool is a seat, which may change height between a minimum height and a maximum height by activating a motor to move a scissor jack located beneath the seat. The motor may be battery-operated. A plurality of wheels may allow the height-adjusting stool to be repositioned by rolling to one side or the other. One or more wheel locks may prevent the plurality of wheels from rolling when stationary positioning is desired. A three-position switch may allow the user to move the seat up or down or to cease motion of the seat.

An object of the invention is to provide a stool having an adjustable height seat.

Another object of the invention is to adjust the height of the seat using a scissor jack mechanism.

A further object of the invention is to provide wheels to move the seat laterally.

Yet another object of the invention is to operate the scissor jack from a battery-operated motor controlled by a user-accessible switch.

These together with additional objects, features and advantages of the height-adjusting stool will be readily apparent to those of ordinary skill in the art upon reading the following detailed description of the presently preferred, but nonetheless illustrative, embodiments when taken in conjunction with the accompanying drawings.

In this respect, before explaining the current embodiments of the height-adjusting stool in detail, it is to be understood that the height-adjusting stool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the height-adjusting stool.

It is therefore important that the claims be regarded as including such equivalent construction insofar as they do not depart from the spirit and scope of the height-adjusting stool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
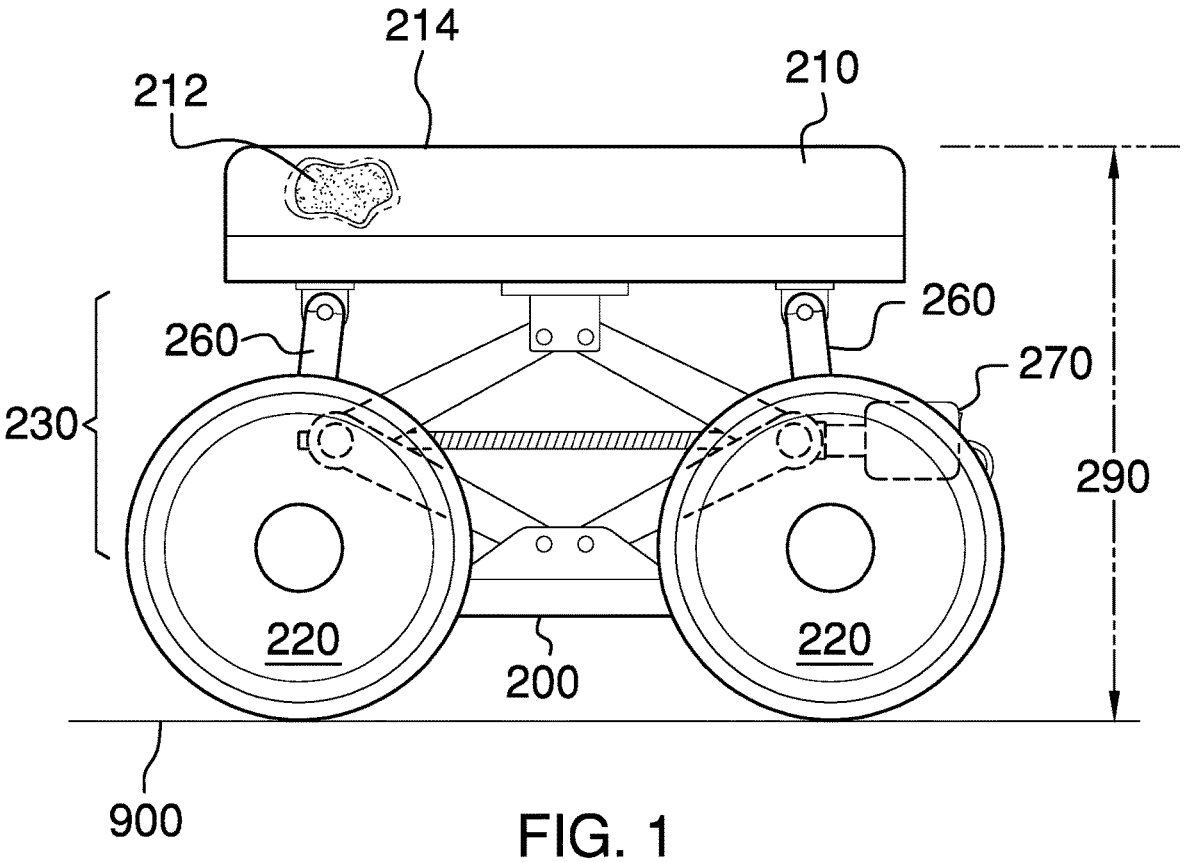
FIG. 1 is a front view of an embodiment of the disclosure.
Figure 2:
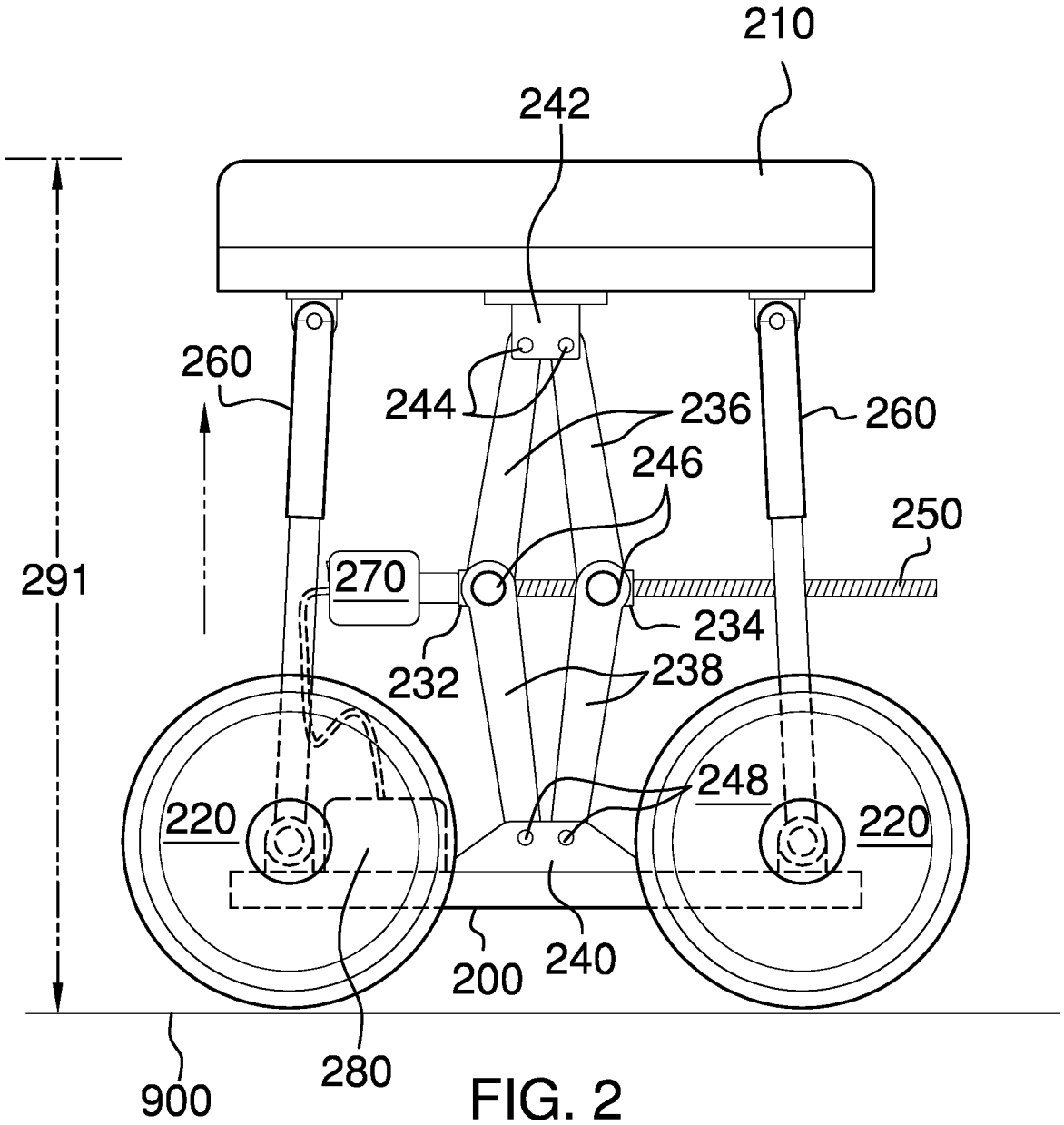
FIG. 2 is a rear view of an embodiment of the disclosure.
Figure 3:
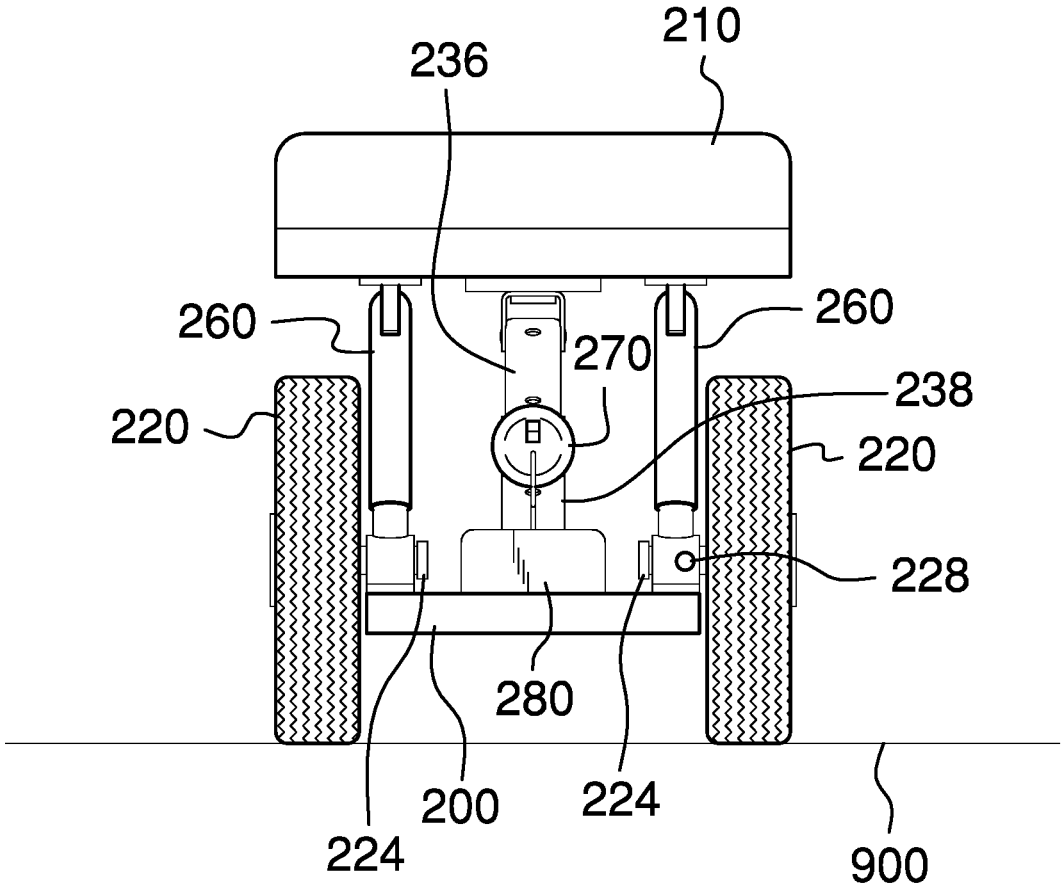
FIG. 3 is a side view of an embodiment of the disclosure.
Figure 4:
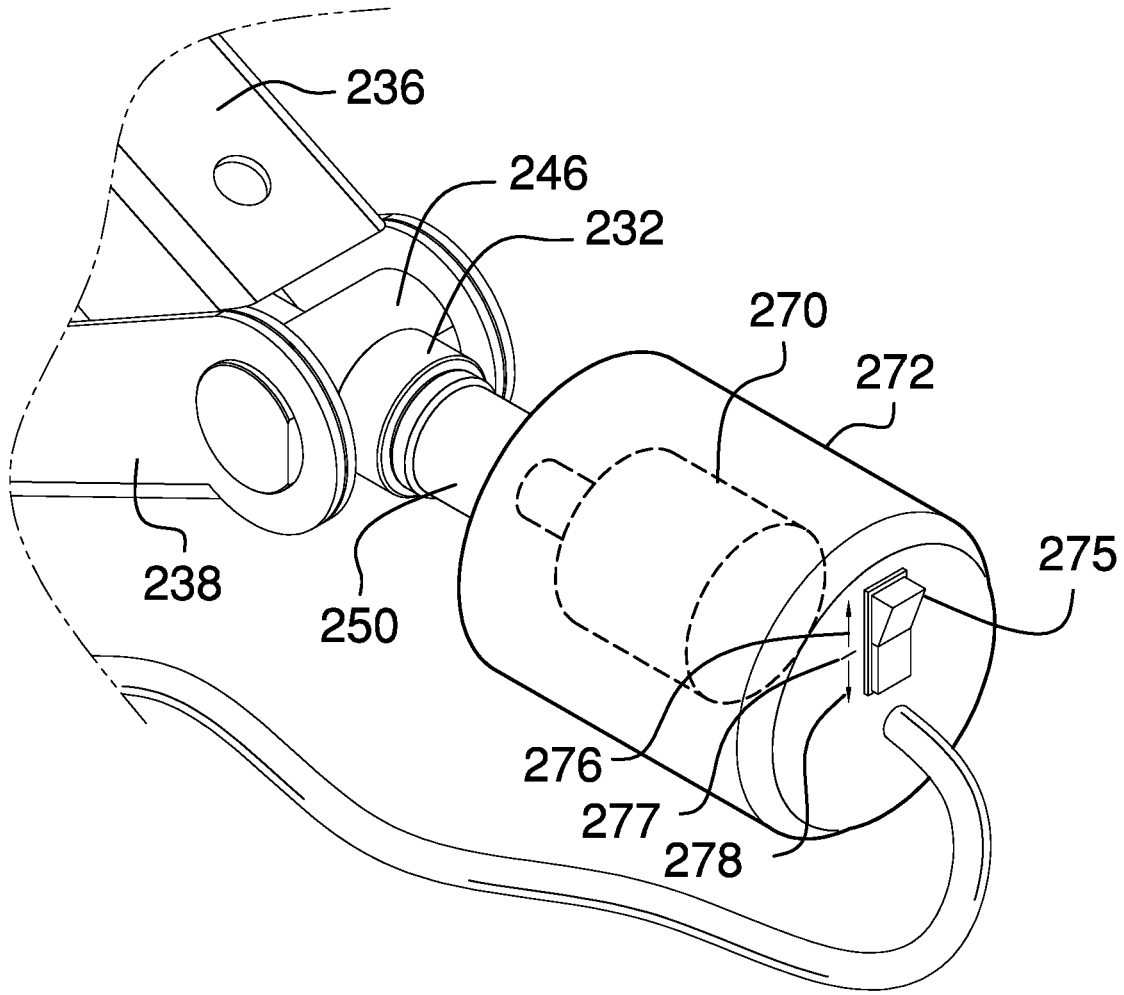
FIG. 4 is a detail view of an embodiment of the disclosure illustrating the motor coupling to the scissor jack.

Detailed reference will now be made to a first potential embodiment of the disclosure, which is illustrated in FIGS. 1 through 4.

The height-adjusting stool 100 (hereinafter invention) comprises a seat base 200, a seat 210, a plurality of wheels 220, one or more wheel locks 228, a scissor jack 230, a plurality of struts 260, a motor 270, a switch 275, and one or more batteries 280. The invention 100 may change height between a minimum height 290 and a maximum height 291 by activating the motor 270 to move the scissor jack 230 located beneath the seat 210. The motor 270 may be battery-operated. The plurality of wheels 220 may allow the invention 100 to be repositioned by rolling to one side or the other. The one or more wheel locks 228 may prevent the plurality of wheels 220 from rolling when stationary positioning is desired.

The seat base 200 may be a horizontally-oriented plate which the plurality of wheels 220, the scissor jack 230, the one or more batteries 280, and the plurality of struts 260 are mounted upon. The seat base 200 may be elevated above ground level 900 by the plurality of wheels 220.

The seat 210 may be a horizontally-oriented surface for sitting upon. The top of the seat 210 may comprise padding 212 for comfort. The padding 212 may be protected and concealed by a covering 214. As non-limiting examples, the covering 214 may be vinyl or fabric.

The plurality of wheels 220 may be coupled to the seat base 200 via their axles 224. The plurality of wheels 220 may be configured to allow the invention 100 to roll to one side or the other. As a non-limiting example, there may be two of the wheels mounted on the front of the seat base 200 and two of the wheels mounted on the back of the seat base 200 with the axis of rotation of the plurality of wheels 220 aligned from front to back. In some embodiments, the diameter of an individual wheel selected from the plurality of wheels 220 may be greater than or equal to 3 inches such that the plurality of wheels 220 roll over outdoor terrain.

The one or more wheel locks 228 may prevent the individual wheels from turning when the one or more wheel locks 228 are engaged and may permit turning when disengaged. The one or more wheel locks 228 may be engaged and disengaged manually. As non-limiting examples, the one or more wheel locks 228 may be sliding pins that interfere with rotation of the individual wheels or friction pads that brake the individual wheels.

The scissor jack 230 may comprise a jack base 240, a jack top 242, a jack screw 250, a pair of upper arms 236, a pair of lower arms 238, a slip joint 232, a screw joint 234, a pair of top hinges 244, a pair of center hinges 246, and a pair of bottom hinges 248. The scissor jack 230 may raise and lower the jack top 242 relative to the jack base 240 due to a scissoring action of the pair of upper arms 236 and the pair of lower arms 238 as the jack screw 250 forces the slip joint 232 and the screw joint 234 to move laterally. The tops of the pair of upper arms 236 may be hingedly coupled to the jack top 242 via the pair of top hinges 244. The bottoms of the pair of upper arms 236 may be hingedly coupled to the slip joint 232 and to the screw joint 234 via the pair of center hinges 246. The slip joint 232 may be located on one side of the scissor jack 230 and the screw joint 234 may be located at the opposing side of the scissor jack 230. The bottoms of the pair of lower arms 238 may be hingedly coupled to the jack base 240 via the pair of center hinges 246. The tops of the pair of lower arms 238 may be hingedly coupled to the slip joint 232 and to the screw joint 234 via the pair of center hinges 246. The jack screw 250 may pass laterally through the scissor jack 230 from the slip joint 232 to the screw joint 234. The jack screw 250 may be threaded along 75 percent or more of its length. The threaded end of the jack screw 250 may pass through the screw joint 234. The non-threaded end of the jack screw 250 may pass through the slip joint 232. The jack screw 250 may be free to rotate in both the slip joint 232 and the screw joint 234. The jack screw 250 may be prevented from moving laterally through the slip joint 232. Rotation of the jack screw 250 within the screw joint 234 may cause the screw joint 234 to move laterally along the jack screw 250. Rotation of the jack screw 250 may cause the screw joint 234 to move towards the slip joint 232 or away from the slip joint 232, depending upon the direction of rotation. As the slip joint 232 and the screw joint 234 are pulled together, the jack top 242 may be elevated above the jack base 240. As the slip joint 232 and the screw joint 234 are pushed apart, the jack top 242 may be lowered towards the jack base 240.

The top of the jack top 242 may be coupled to the underside of the seat 210. The bottom of the jack base 240 may be coupled to the top surface of the seat base 200. The seat 210 may achieve the maximum height 291 when the jack top 242 and the jack base 240 are at maximum separation. The seat 210 may achieve the minimum height 290 when the jack top 242 and the jack base 240 are at minimum separation.

The plurality of struts 260 may support and guide vertical motion of the seat 210. The tops of the plurality of struts 260 may couple to the underside of the seat 210. The bottoms of the plurality of struts 260 may couple to the top of the seat base 200. An individual strut selected from the plurality of struts 260 may be a telescoping support that tends to level the seat 210. In some embodiments, the plurality of struts 260 may be pneumatic or hydraulic shock absorbers.

The motor 270 may be coupled to the side of the scissor jack 230 adjacent the slip joint 232. The motor 270 may convert electrical energy into mechanical energy. The motor 270 may cause rotation of the jack screw 250 when electrical energy is applied to the motor 270. The electrical energy applied to the motor 270 may be controlled by the switch 275. The motor 270 may be energized by an electrical potential having a first polarity which may cause the motor 270 to rotate the jack screw 250 in a first direction. Rotation of the jack screw 250 in the first direction may cause the slip joint 232 and the screw joint 234 to pull together thus raising the seat 210. The motor 270 may be energized by an electrical potential having a second polarity which may cause the motor 270 to rotate the jack screw 250 in a second direction. Rotation of the jack screw 250 in the second direction may cause the slip joint 232 and the screw joint 234 to push apart thus lowering the seat 210.

The switch 275 may be an electrical component comprising one or more sets of electrical contacts. The switch 275 may start and stop the flow of electricity through an electric circuit touching or separating the electrical contacts, thus completing or interrupting an electric circuit. In some embodiments, the switch 275 may be mounted on a motor housing 272. in some embodiments, the switch 275 may have three positions. In a first switch position 276, an electrical potential having the first polarity may be applied to the motor 270 thus causing the seat 210 to be raised. In a second switch position 277, no electrical potential may be applied to the motor 270 thus stopping rotation of the jack screw 250. In a third switch position 278, an electrical potential having the second polarity may be applied to the motor 270 thus causing the seat 210 to be lowered. In some embodiments, the first switch position 276 and the third switch position 278 may be momentary contact such that when released the switch 275 may return to the second switch position 277 may de-energize the motor 270.

The one or more batteries 280 may comprise one or more energy-storage devices. The one or more batteries 280 may be a source of electrical energy to operate the motor 270. The one or more batteries 280 may be replaceable or rechargeable.

In use, a user may sit on the seat 210 while the seat 210 is at the maximum height 291, which places less stress on their knees and back. The user may then place the switch 275 into the third switch position 278 to lower the seat 210. When the seat 210 reaches the minimum height 290, or before that if desired, the user may release the switch 275 and the switch 275 may return to the second switch position 277, stopping movement of the seat 210.

The user may move laterally by disengaging the one or more wheel locks 228 and push to one side or the other. When in a desired location, the one or more wheel locks 228 may be engaged to hold that location.

To get up, the user may then place the switch 275 into the first switch position 276 to raise the seat 210. When the seat 210 reaches the maximum height 291, or before that if desired, the user may release the switch 275 and the switch 275 may return to the second switch position 277, stopping movement of the seat 210. The user may then stand.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "axle" is a cylindrical shaft that is inserted through the center of an object such that the center axis of the object and the center axis of the axle are aligned and the object can rotate using the axle as an axis of rotation.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "brake" is a device that is used to slow or stop the motion of a machine or a vehicle.

As used herein, the words "couple", "couples", "coupled" or "coupling", refer to connecting, either directly or indirectly, and does not necessarily imply a mechanical connection.

As used herein, the word "desired" refers to a specific value or action within a range of supported values or action. A "desired" value or action indicates that a range of values or actions is enabled by the invention and that a user of the invention may select a specific value or action within the supported range of values or action based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, a "diameter" of an object is a straight line segment that passes through the center (or center axis) of an object. The line segment of the diameter is terminated at the perimeter or boundary of the object through which the line segment of the diameter runs.

As used herein, "energize" and/or "energization" refer to the application of an electrical potential to a system or subsystem.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, a "housing" is a rigid casing that encloses and protects one or more devices.

As used in this disclosure, the word "lateral" refers to the sides of an object or movement towards a side. Lateral directions are generally perpendicular to longitudinal directions. "Laterally" refers to movement in a lateral direction.

As used in this disclosure, a "motor" refers to a device that transforms energy from an external power source into mechanical energy.

As used in this disclosure, a "plate" is a flat, rigid object having at least one dimension that is of uniform thickness and is thinner than the other dimensions of the object. Plates often have a rectangular or disk like appearance. Plates may be made of any material, but are commonly made of metal.

As used in this disclosure, a "switch" is an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

As used in this disclosure, "telescopic", "telescoping", and "telescopically" refer to an object made of sections that fit or slide into each other such that the object can be made longer or shorter by adjusting the relative positions of the sections.

As used in this disclosure, "vertical" refers to a direction that is parallel to the local force of gravity. Unless specifically noted in this disclosure, the vertical direction is always perpendicular to horizontal.

As used in this disclosure, a "wheel" is a circular object that revolves around an axle or an axis and is fixed below an object to enable it to move easily over the ground.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A height-adjusting stool comprising:

a seat base, a seat, a plurality of wheels, one or more wheel locks, a scissor jack, a plurality of struts, a motor, a switch, and one or more batteries;

wherein the height-adjusting stool changes height between a minimum height and a maximum height by activating the motor to move the scissor jack located beneath the seat;

wherein the motor is battery-operated;

wherein the plurality of wheels allow the height-adjusting stool to be repositioned by rolling to one side or the other;

wherein the one or more wheel locks prevent the plurality of wheels from rolling when stationary positioning is desired;

wherein the scissor jack comprises a jack base, a jack top, a jack screw, a pair of upper arms, a pair of lower arms, a slip joint, a screw joint, a pair of top hinges, a pair of center hinges, and a pair of bottom hinges;

wherein the scissor jack raises and lowers the jack top relative to the jack base due to a scissoring action of the pair of upper arms and the pair of lower arms as the jack screw forces the slip joint and the screw joint to move laterally;

wherein a top of the jack top is coupled to an underside of the seat;

wherein the bottom of the jack base is coupled to a top surface of the seat base;

wherein the seat achieves the maximum height when the jack top and the jack base are at maximum separation;

wherein the seat achieves the minimum height when the jack top and the jack base are at minimum separation;

wherein the plurality of struts support and guide vertical motion of the seat;

wherein tops of the plurality of struts couple to an underside of the seat;

wherein bottoms of the plurality of struts couple to a top of the seat base;

wherein an individual strut selected from the plurality of struts is a telescoping support that tends to level the seat.

2. The height-adjusting stool according to claim 1 wherein the seat base is a horizontally-oriented plate which the plurality of wheels, the scissor jack, the one or more batteries, and the plurality of struts are mounted upon;

wherein the seat base is elevated above ground level by the plurality of wheels.

3. The height-adjusting stool according to claim 2 wherein the seat is a horizontally-oriented surface for sitting upon;

wherein a top of the seat comprises padding for comfort;

wherein the padding is protected and concealed by a covering.

4. The height-adjusting stool according to claim 3 wherein the plurality of wheels are coupled to the seat base via their axles;

wherein the plurality of wheels are configured to allow the height-adjusting stool to roll to one side or the other.

5. The height-adjusting stool according to claim 4 wherein there are two of the wheels mounted on the front of the seat base and two of the wheels mounted on the back of the seat base with the axis of rotation of the plurality of wheels aligned from front to back.

6. The height-adjusting stool according to claim 5 wherein the diameter of an individual wheel selected from the plurality of wheels is greater than or equal to three inches such that the plurality of wheels roll over outdoor terrain.

7. The height-adjusting stool according to claim 5 wherein the one or more wheel locks prevent the individual wheels from turning when the one or more wheel locks are engaged and permit turning when disengaged;

wherein the one or more wheel locks are engaged and disengaged manually.

8. The height-adjusting stool according to claim 7 wherein tops of the pair of upper arms are hingedly coupled to the jack top via the pair of top hinges;

wherein bottoms of the pair of upper arms are hingedly coupled to the slip joint and to the screw joint via the pair of center hinges;

wherein the slip joint is located on one side of the scissor jack and the screw joint is located at an opposing side of the scissor jack;

wherein the bottoms of the pair of lower arms are hingedly coupled to the jack base via the pair of center hinges;

wherein tops of the pair of lower arms are hingedly coupled to the slip joint and to the screw joint via the pair of center hinges.

9. The height-adjusting stool according to claim 8 wherein the jack screw passes laterally through the scissor jack from the slip joint to the screw joint;

wherein the jack screw is threaded along seventy-five percent or more of its length;

wherein the threaded end of the jack screw passes through the screw joint;

wherein the non-threaded end of the jack screw passes through the slip joint;

wherein the jack screw is free to rotate in both the slip joint and the screw joint;

wherein the jack screw is prevented from moving laterally through the slip joint.

10. The height-adjusting stool according to claim 9 wherein rotation of the jack screw within the screw joint causes the screw joint to move laterally along the jack screw;

wherein rotation of the jack screw causes the screw joint to move towards the slip joint or away from the slip joint, depending upon the direction of rotation;

wherein as the slip joint and the screw joint are pulled together, the jack top is elevated above the jack base;

wherein as the slip joint and the screw joint are pushed apart, the jack top is lowered towards the jack base.

11. The height-adjusting stool according to claim 10 wherein the plurality of struts are pneumatic or hydraulic shock absorbers.

12. The height-adjusting stool according to claim 10 wherein the motor is coupled to a side of the scissor jack adjacent the slip joint;

wherein the motor converts electrical energy into mechanical energy;

wherein the motor causes rotation of the jack screw when electrical energy is applied to the motor;

wherein the electrical energy applied to the motor is controlled by the switch;

wherein the motor is energized by an electrical potential having a first polarity which causes the motor to rotate the jack screw in a first direction;

wherein rotation of the jack screw in the first direction causes the slip joint and the screw joint to pull together thus raising the seat;

wherein the motor is energized by an electrical potential having a second polarity which causes the motor to rotate the jack screw in a second direction;

wherein rotation of the jack screw in the second direction causes the slip joint and the screw joint to push apart thus lowering the seat.

13. The height-adjusting stool according to claim 12 wherein the switch is an electrical component comprising one or more sets of electrical contacts;

wherein the switch starts and stops the flow of electricity through an electric circuit touching or separating the electrical contacts, thus completing or interrupting an electric circuit.

14. The height-adjusting stool according to claim 13 wherein the switch is mounted on a motor housing.

15. The height-adjusting stool according to claim 13 wherein the switch has three positions;

wherein in a first switch position, an electrical potential having the first polarity is applied to the motor thus causing the seat to be raised;

wherein in a second switch position, no electrical potential is applied to the motor thus stopping rotation of the jack screw;

wherein in a third switch position, an electrical potential having the second polarity is applied to the motor thus causing the seat to be lowered.

16. The height-adjusting stool according to claim 15 wherein the first switch position and the third switch position are momentary contact such that when released the switch returns to the second switch position and de-energizes the motor.

17. The height-adjusting stool according to claim 13 wherein the one or more batteries comprise one or more energy-storage devices;

wherein the one or more batteries are a source of electrical energy to operate the motor;

wherein the one or more batteries are replaceable or rechargeable.

* * * * *